United States Patent [19]

Vogel et al.

[11] 4,242,101

[45] Dec. 30, 1980

[54] FUELS FOR GASOLINE ENGINES

[75] Inventors: Hans-Henning Vogel, Frankenthal; Knut Oppenlaender, Ludwigshafen; Klaus Starke, Weisenheim, all of Fed. Rep. of Germany

[73] Assignee: BASF Aktiengesellschaft, Fed. Rep. of Germany

[21] Appl. No.: 48,478

[22] Filed: Jun. 14, 1979

[30] Foreign Application Priority Data

Jun. 26, 1978 [DE] Fed. Rep. of Germany ..... 2828038

[51] Int. Cl.[3] ..... C10L 1/22

[52] U.S. Cl. ..... 44/58; 44/63

[58] Field of Search ..... 44/63, 71, 58, 77; 544/385

[56] References Cited

U.S. PATENT DOCUMENTS

| | | | |
|---|---|---|---|
| 3,173,770 | 3/1965 | Thompson et al. | 44/71 |
| 3,196,153 | 7/1965 | Dazzi | 544/385 |
| 3,463,731 | 8/1969 | Ecke et al. | 44/78 |
| 3,923,474 | 12/1975 | Yount | 44/71 |

*Primary Examiner*—Patrick Garvin
*Assistant Examiner*—Y. Harris-Smith
*Attorney, Agent, or Firm*—Keil & Witherspoon

[57] ABSTRACT

Fuels for gasoline engines, which contain small amounts of (a) imides or amide-imides, or mixtures of imides and amide-imides, obtained from nitrilotriacetic acid and/or from ethylenediaminetetraacetic acid and amines or amine mixtures of 7 to 18 carbon atoms, of the formula I

I where the radicals X are identical or different radicals —HN—R, or adjacent radicals X are a radical which completes a ring m is 0 or 1 and R is an unbranched or branched aliphatic radical of 7 to 18 carbon atoms, as valve and carburetor cleaners, and (b) mixtures of highly hydrogenated petroleum distillates, in the boiling range of the kerosine fraction and highly refined solvent raffinates with viscosities of from 50 to 500 $mm^2/s$ at 40° C., the weight ratio of these constituents being from 20:80 to 80:20, keep the carburetors and valves of gasoline engines clean, thereby achieving better combustion of the fuel in the engine.

10 Claims, 1 Drawing Figure

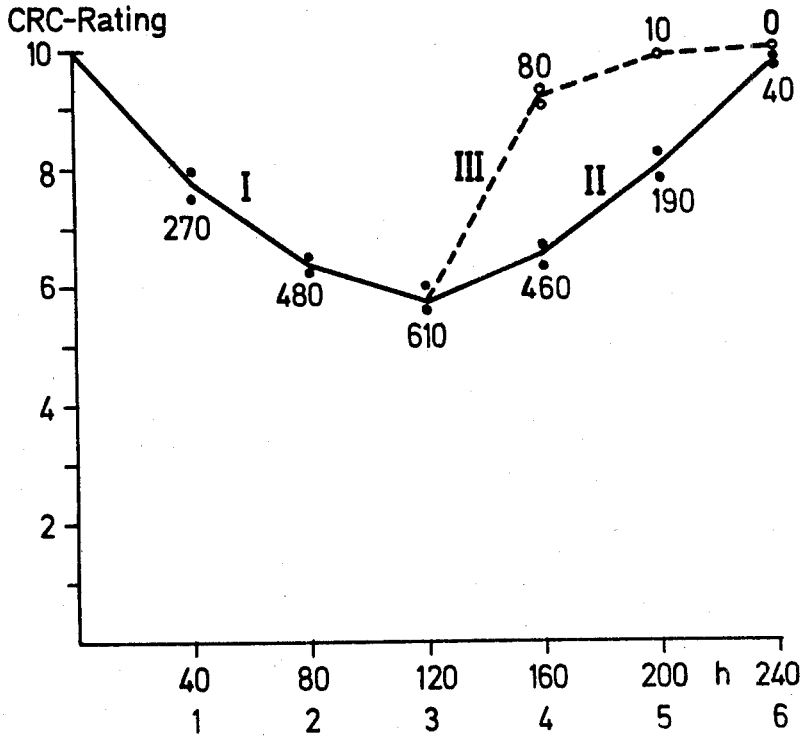
CRC-Rating
10
8
6
4
2
I
II
III
270
480
610
460
190
40
80
10
0
40
80
120
160
200
h
240
1
2
3
4
5
6

FUELS FOR GASOLINE ENGINES

The present invention relates to fuels for gasoline engines, containing (a) amide-imides or imides of nitrilotriacetic acid or of ethylenediaminetetraacetic acid and (b) a lubricating oil mixture consisting of a kerosine fraction and a solvent raffinate.

German Laid-Open Application DOS No. 2,624,630 discloses the addition, to engine fuels, of small amounts of the imides or amide-imides obtained from nitrilotriacetic acid and amines and/or of the imides or amide-imides obtained from ethylenediaminetetraacetic acid and amines, to prevent deposits on the inlet valves and carburetors of gasoline engines and to prevent the resulting disturbance of the composition of the fuel-air mixture.

Further, it has been disclosed, for example in German Pat. No. 2,144,199, that reaction products of polyamines, eg. diethylenetriamine, with saturated or unsaturated fatty acids, eg. stearic acid or oleic acid, are good carburetor cleaners. However, if used by themselves in the fuel they tend, at higher concentrations, eg. at above 50–100 ppm, to form deposits on the valves.

It is true that the first-mentioned imides and amide-imides, used at the stated concentration range, also serve to clean the carburetor, but they are, essentially, good valve cleaners, which are advantageously combined with special carburetor cleaners.

However, such combination is as a rule only possible within defined narrow weight ratios of the two categories of compounds which have been mentioned. If other weight ratios are chosen, especially in the case of engine fuels and lubricants which particularly tend to soil the engine inlet system, in which case high proportions of carburetor cleaners are necessary, the valve-cleaning effect of the said imides and amide-imides is partly or even completely cancelled out again.

It is an object of the present invention to provide an additive, to be used with the imides and amide-imides of nitrilotriacetic acid and of ethylenediaminetetraacetic acid, which are highly effective valve cleaners, with the aid of which it becomes possible to combine these imides and amide-imides with other conventional carburetor-cleaning additives without loss of their efficiency and preferably even with a synergistic increase in efficiency.

We have found that this object is achieved, surprisingly, if a lubricating oil composed of a mixture of a kerosine fraction and a highly refined solvent fraction is added to the imides or amide-imides of nitrilotriacetic acid or of ethylenediaminetetraacetic acid.

Accordingly, the invention relates to fuels for gasoline engines, which contain small amounts of (a) imides or amide-imides, or mixtures of imides and amide-imides, obtained from nitrilotriacetic acid and/or from ethylenediaminetetraacetic acid and amines or amine mixtures of 7 to 18 carbon atoms, of the formula I

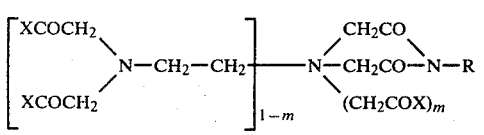

I where the radicals X are identical or different radicals—HN—R, or adjacent radicals X are a radical

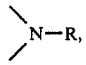

which completes a ring

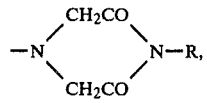

m is 0 or 1 and R is an unbranched or branched aliphatic radical of 7 to 18 carbon atoms, as valve and carburetor cleaners, and (b) mixtures of highly hydrogenated petroleum distillates, in the boiling range of the kerosine fraction, said highly refined solvent raffinates with viscosities of from 50 to 500 $mm^2/s$ at 40° C., the weight ratio of these constituents being from 20:80 to 80:20.

The addition of small amounts of lubricating oils to gasoline engine fuels is known per se. Small amounts, for example 2,000 ppm, of a conventional two-stroke oil have already been added, as upper cylinder lubricants, to engine fuels, in order to lubricate the valves.

However, such addition, by itself, is of only limited effectiveness as a cleaner for the inlet valves and the carburetor. Furthermore, the effect depends on the origin of the crude oil, on the degree of refining and on the viscosity of the lubricating oil cut. Furthermore, the amounts which have to be added to achieve an effect are relatively high, for example 0.2% by volume or more, so that uncombusted hydrocarbons can occur in the exhaust gas.

According to the invention, mixtures of particularly thoroughly hydrogenated fractions in the boiling range of kerosine: (i.e. having an approximate boiling range of from 180° to 300° C. and preferably from 200° to 280° C.), with highly refined (hydrogenated) solvent raffinates are used instead. Highly refined solvent raffinates with viscosities (at 20° C.) of from 50 to 500 $mm^2/s$, for example from 200 to 250 $mm^2/s$, have proved particularly effective components for mixing with the kerosine cuts. The ratio of kerosine to solvent raffinate in the mixture can range from 20:80 to 80:20, a preferred ratio being 50:50.

The viscosity is a decisive factor in the preparation of such lubricating oil cuts for use as components in the fuel additives according to the invention. The solvent power of the lubricating oil cuts, in combination with imides of amide-imides of nitrilotriacetic acid or of ethylenediaminetetraacetic acid, with or without conventional carburetor detergents, manifests itself most if, under the temperature conditions prevailing at the inlet valve and in the carburetor, the lubricating oil is on the one hand non-volatile or only slightly volatile but on the other hand not excessively viscous so that the dissolved-off deposits can still easily run off. The properties of such special lubricating oil cuts may for example lie in the following ranges:

| | |
|---|---|
| Density (at 15° C.) | from 0.85 to 0.95 $g/cm^3$ |
| Viscosity (at 20° C.) | from 10 to 200 $mm^2/s$ |

-continued

| | |
|---|---|
| Viscosity (at 50° C.) | from 3 to 30 $mm^2/s$ |
| Pour point (minimum) | below −20° C. |

Lubricating oil cuts with other characteristics may however also be suitable, depending on the choice of the ratio of kerosine fraction to solvent raffinate.

The compounds according to (a), of the formula I, are obtained by conventional methods, for example by reacting nitrilotriacetic acid or ethylenediaminetetraacetic acid with an amine or mixture of amines of the formula $R—NH_2$ at from 150° to 220° C., as a rule from 160° to 200° C. Depending on the desired product, the amine or amine mixture is employed in a molar ratio of 2:1 (giving the cyclic diimide) or of 3:1 (giving the amide-imide) relative to ethylenediaminetetraacetic acid, or in a ratio of 2:1 (giving the amide-imide) relative to nitrilotriacetic acid, or in slightly larger amounts than this. In this way, predominantly amide-imides or imides are obtained in every case, in addition to minor amounts of amides, i.e. where all the carbonyl groups are substituted by one amide radical each.

Specifically, the procedure followed is that the amine or amine mixture is introduced under nitrogen into a stirred vessel, the nitrilotriacetic acid or ethylenediaminetetraacetic acid is then introduced at about 80° C. and the mixture is heated, whilst stirring, for 4–10 hours at 160°–200° C., or in the case of slow-reacting amines or amine mixtures at higher temperatures, after which time the acid number is less than 10.

Suitable amines of the formula $$R—NH_2$$

are those of 7 to 18, preferably of 8 to 14, carbon atoms. These compounds may contain yet further amino groups, for example non-primary amino groups, or alkoxy groups. Furthermore, oxygen atoms may be present in the chain.

Specific examples of suitable amines are the following, in which the alkyl radicals may be interrupted by nitrogen or oxygen: 2-ethylhexylamine, n-dodecylamine, n-tridecylamine, n-pentadecylamine, stearylamine, 2-amino-5-dimethylaminopentane and 1-(2-ethylhexoxy)-propyl-3-amine.

In some cases, the use of amine mixtures has also proved advantageous.

Examples of conventional carburetor cleaners (c) suitable for use in combination with the additives (a) and (b) according to the invention are the products described in German Pat. No. 2,144,199. More particularly, these are amides of $C_{12}$–$C_{20}$-fatty acids with polyamines of 2 to 4 nitrogen atoms and 2 to 8 carbon atoms, eg. the diamides derived from diethylenetriamine and 2 moles of oleic acid, from dipropylenetriamine and 2 moles of stearic acid, from diethylenetriamine and 2 moles of palmitic acid and from methyldipropylenetriamine and 2 moles of lauric acid. Further suitable reaction products are those of the said acid with aminoethylpropylenediamine or with bis-aminopropylpropylenediamine.

The carburetor cleaners (c) are as a rule employed in a weight ratio, relative to the sum of components (a) and (b), of 1:0.01–0.2.

The novel fuel additives not only keep clean the inlet components of the engine but also exert a soil-dissolving action on soiled carburetors and valves. Since the lubricating oil mixture is used in relatively small amounts, for example from 0.001 to 0.03% by volume, there is no pollution of the environment by hydrocarbon constituents in the exhaust gases. Finally, as already mentioned, there is a substantial boosting of the effect compared to that achieved by the sole use of the imides or imides-amide of nitrilotriacetic acid or of ethylenediaminetetraacetic acid, with or without carburetor detergents.

In addition to the mixtures of the imides or amide-imides with the special lubricating oils and the carburetor detergents, the fuels according to the invention may additionally contain conventional phenol-based or amine-based antioxidants. In particular, it is advantageous to combine fuel additives for cleaning, and keeping clean, the inlet system with phenolic antioxidants for increasing the stability of the fuels on storage.

Residual oils from the synthesis of oxo-alcohols have proved to be good solvents or solubilizing agents for the abovementioned components to be added to the fuels.

Preferably, oxo-alcohol residues from the synthesis of butanol, isobutanol, pentanol, hexanol, heptanol, octanol, nonanol, decanol, undecanol or dodecanol are used. The use of oxo-alcohol residues from the synthesis of butanol is particularly advantageous. However, other solvents or solvent mixtures which give a homogeneous mixture of the components in the weight ratios mentioned above can also be used. The effect of the gasoline additives according to the invention is not restricted to automotive fuels. We have found that they can also be used in aviation fuels, especially in aviation fuels for piston engines. Furthermore, the compounds according to the invention are not only effective in carburetor engine systems but also in engines with fuel injection.

The fuels containing the novel additive can additionally contain other, conventional additives, for example additives which improve the octane number, eg. lead compounds, or oxygen-containing components, eg. methanol or methyl tertiary butyl ether.

In other respects, the gasoline engine fuels are characterized by conventional properties. Their volatility ranges, at 100° F. (37.8° C.), from 6 lbs/sq. in. (0.41 bar) to 16 lbs/sq.in. (1.03 bars); the range of "50% points" in the ASTM-D-86 test is from 170° F. (77° C.) to 270° F. (132° C.). The ASTM end point of automotive gasoline is from 350° F. (176° C.) to 450° F. (232° C.). Complete specifications for automotive gasolines, i.e. fuel M, regular and premium grades of classes A, B and C, are given in U.S. Federal Specification VV-M-561 a-2 Oct. 30, 1954.

The fuel additives are generally introduced into the gasoline in amounts of from 10 to 2,000 ppm by volume, preferably from 50 to 1,000 ppm by volume. The weight ratios of the individual components in the fuel additives can vary within relatively wide limits. Examples of particularly effective combinations are those which contain (a) from 1 to 10 parts by weight of the valve-cleaning and carburetor-cleaning compounds, namely of the imides or amide-imides of nitrilotriacetic acid and/or of ethylenediaminetetraacetic acid and (b) from 1 to 10 parts by weight of the lubricating oil mixture described above, with or without (c) from 0.15 to 1.5 parts by weight of carburetor detergents, for example the condensation products of saturated or unsaturated $C_{12}$–$C_{20}$ fatty acids and polyamines of 2 to 8 carbon atoms and 2 to 4 nitrogen atoms, and also with or without (d) from 0.15 to 1.5 parts by weight of a phenolic antioxidant, for example an alkyl-substituted sterically hindered phenol and (e) from 1 to 10 parts by weight of an oxo-alcohol residue from the synthesis of butanol, to act as a solvent or solubilizing agent.

An exceptionally effective fuel additive for example contains components a, b, c, d and e in the approximate weight ratio 1:1:0.15:0.15:1.

Other weight ratios are also possible, and depending on the desired effect to be achieved at the inlet valve and/or in the carburetor, the proportion by weight of each individual component in the mixture can vary from 0.01 to 10.

Furthermore, depending on the desired effect of the fuel additive, the carburetor detergent c and/or the phenolic antioxidant d may be omitted entirely.

The Examples which follow show the cleaning, and keeping-clean, action of the fuel additives according to the invention.

ENGINE TEST

Keeping-clean effect on the carburetor and inlet system

The fuel additives shown in the Examples of Table 1 were added to the fuel of an Opel-Kadett 1.2 liter test engine (55 HP at 5,200 rpm). The test engine was run under the following conditions:

| | |
|---|---|
| Test duration: | 40 hours |
| Test program: | 0.5 min idling at 100 rpm<br>1 min at 3,000 rpm and 11 kW (corresponding to 80 km/h)<br>1 min at 1,300 rpm and 4 kW (corresponding to 35 km/h)<br>1 min at 1,850 rpm and 6.25 kW (corresponding to 50 km/h) |
| Engine running conditions: | |
| Temperature of engine oil in sump | 94 ± 2° C. |
| Temperature of coolant (cylinder head outlet) | 92 ± 2° C. |
| Air intake temperature (when idling) | 100° C. |
| Carbon monoxide content in exhaust gas, when idling, at start of test | 3.5 ± 0.5% by volume |

All the tests were carried out under the above constant engine conditions and the same fuel was used in all tests.

The Table shows the results of the engine tests using the additives according to the invention.

The cleanliness of the carburetor and valves was assessed on the "CRC rating" scale for diesel engines (CRC merit rating: 10.0=100% clean).

The Table shows, in Example 1, the rating of the carburetor and inlet valve for a fuel without additive, and in Examples 2 to 5 the effect of the fuel additives described in German Laid-Open Application DOS No. 2,624,630, used by themselves.

Examples 6 and 7 show the improvement achieved when using a combination according to the invention.

The same applies to Examples 8 and 9 in the Table.

TABLE:

Examples of the keeping-clean effect of the fuel additives according to the invention

| Example No. | A ppm by volume | B[6] ppm by volume | C[5] ppm by volume | D[7] ppm by volume | E[8] ppm by volume | CRC rating Carburetor | CRC rating Inlet valves[1] | Residue on the valves[2] (mg/valve) |
|---|---|---|---|---|---|---|---|---|
| 1 | — | — | — | — | — | 7.9 | 8.0 | 290 |
| 2 | 250[3] | — | — | — | — | 9.8 | 10.0 | 9 |
| 3 | 150[3] | — | — | — | — | 9.1 | 9.4 | 61 |
| 4 | 250[4] | — | — | — | — | 9.4 | 9.9 | 30 |
| 5 | 150[4] | — | — | — | — | 8.6 | 9.0 | 93 |
| 6 | 150[3] | 150 | 25 | 5 | 150 | 10.0 | 10.0 | 0 |
| 7 | 150[3] | 150 | 25 | 15 | 150 | 10.0 | 10.0 | 0 |
| 8 | 150[4] | 150 | 25 | 5 | 150 | 9.7 | 9.5 | 62 |
| 9 | 150[4] | 250 | 30 | 5 | 150 | 9.9 | 9.9 | 18 |

Legend for Table:
[1]Average rating of 2 valves
[2]Mean value of 2 valves in mg/valve
[3]Reaction product of 1 mole of ethylenediaminetetraacetic acid with 3 moles of n-tridecylamine
[4]Reaction product of 1 mole of nitrilotriacetic acid with 2 moles of 2-ethylhexylamine
[5]Diamide of diethylenetriamine with 2 moles of oleic acid
[6]Lubricating oil mixture (weight ratio of 50:50) of a hydrogenated kerosine fraction (boiling range 240-260° C.) and a highly refined solvent raffinate (viscosity 10 $mm^2/s$ at 50° C.)
[7]Mixture of 2,4-di-tert.-butylphenol (80%) with isomeric di-tert.-butylphenols and 2,4,6-tri-tert.-butylphenol
[8]Residual oil from the oxo-synthesis of n-butanol (consisting essentially of 2-ethylhexanol as the main component (about 35-60%), 4-methyl-2-ethylpentanol (about 4-7%), various butyl butyrates (3-6%), di-n-butylacetal (1-5%), 2-ethylhexyl n-butyrate (1-4%), isomeric pentanols (2-3%) and isomeric butanols (1%).

ENGINE TEST

Cleaning effect on the carburetor and inlet system

The test is carried out in the Opel-Kadett 1.2 liter test engine already described, under the conditions mentioned. To test the cleaning effect of the fuel additives, the engine is run in 3 test cycles, each of 40 hours, first with a fuel not containing additives. After each test cycle, the carburetor and inlet valves are taken out and rated on the CRC scale, and the amount of deposit on the inlet valves is determined. Thereafter, the soiled valves and carburetor are re-fitted and 3 test cycles are again carried out, but this time with a fuel containing an additive according to Example 6, in order to clean the valves and carburetor. Here again, after each cycle, the inlet valves and carburetor are taken out and the progress of the cleaning action of the fuel additives according to the invention is respectively rated on the CRC scale and determined gravimetrically.

The drawing sets forth a graph which illustrates the cleaning effect of the fuel additive on valves and on carburetor parts.

The FIGURE shows the course of a total of 6 engine cycles. Cycles 1 to 3 clearly show the increasing soiling effect when using a fuel without additive. Cycles 4 to 6 show the increasing cleaning effect when using a fuel containing additives according to the invention.

I: fuel without additive

II: fuel containing 500 ppm by volume of the additive according to Example 6

III: fuel containing 1,000 ppm by volume of the additive according to Example 6

The numerical data in the FIGURE denotes the amount of deposit (mean value from 2 test series) in mg per valve.

We claim:

1. An additive for gasoline fuels which comprises a combination of (a) imides or amide-imides, or mixtures of imides and amide-imides, obtained from nitrilotriacetic acid and/or from ethylenediaminetetraacetic acid and amines or amine mixtures of 7 to 18 carbon atoms, of the formula I

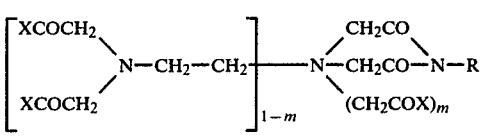

I where the radicals X are identical or different radicals —HN—R, or adjacent radicals X are a radical

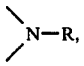

which completes a ring

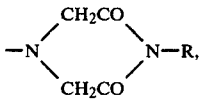

m is 0 or 1 and R is an unbranched or branched aliphatic radical of 7 to 18 carbon atoms, as valve and carburetor cleaners, and (b) mixtures of highly hydrogenated petroleum distillates, in the boiling range of the kerosine fraction, and highly refined solvent raffinates with viscosities of from 50 to 500 $mm^2/s$ at 40° C., the weight ratio of constituents (a) and (b) being from 20:80 to 80:20.

2. The fuel addition of claim 1, which additionally contains (c) saturated and/or unsaturated fatty acid amides obtained from $C_{12}$–$C_{20}$-fatty acids and polyamines of 2 to 8 carbon atoms and 2 to 4 nitrogen atoms.

3. The fuel addition of claim 2, wherein the weight ratio of the sum of (a) and (b) to (c) is 1:0.01–0.2.

4. The fuel addition of claim 1, which additionally contains (d) alkyl-substituted sterically hindered phenols as antioxidants and (e) residues from an oxo-alcohol synthesis, carried out with $C_3$–$C_5$-olefins as a solubilizing agent.

5. The fuel additive of claim 2, which additionally contains (d) alkyl-substituted sterically hindered phenols as antioxidants and (e) residues from an oxo-alcohol synthesis, carried out with $C_3$–$C_5$-olefins as a solubilizing agent.

6. The fuel additive of claim 5, wherein the weight ratio of components a–e is as follows:

(a) from 1 to 10 parts;

(b) from 1 to 10 parts;

(c) from 0.15 to 1.5 parts;

(d) from 0.15 to 1.5 parts; and (e) from 1 to 10 parts.

7. The fuel additive of claim 5, wherein components a, b, c, d and e are in the approximate weight ratio of 1:1:0.15:0.15:1.

8. An improved fuel which comprises in combination: gasoline and from 10 to 2,000 ppm by volume of an additive comprising a combination of (a) imides or amide-imides, or mixtures of imides and amide-imides, obtained from nitrilotriacetic acid and/or from ethylenediaminetetraacetic acid and amines or amine mixtures of 7 to 18 carbon atoms, of the formula I

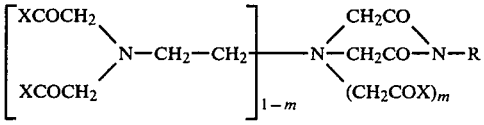

I where the radicals X are identical or different radicals —HN—R, or adjacent radicals X are a radical

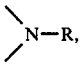

which completes a ring

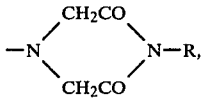

m is 0 or 1 and R is an unbranched or branched aliphatic radical of 7 to 18 carbon atoms, as valve and carburetor cleaners, and (b) mixtures of highly hydrogenated petroleum distillates, in the boiling range of the kerosine fraction, and highly refined solvent raffinates with viscosities of from 50 to 500 $mm^2/s$ at 40° C., the weight ratio of constituents (a) and (b) being from 20:80 to 80:20.

9. The improved fuel of claim 8 wherein the additive also includes (c) saturated and/or unsaturated fatty acid amides obtained from $C_{12}$–$C_{20}$-fatty acids and polyamines of 2 to 8 carbon atoms and 2 to 4 nitrogen atoms wherein the weight ratio of the sum of (a) and (b) to (c) is 1:0.01–0.2.

10. The improved fuel of claim 9 wherein the additive also includes (d) alkyl-substituted sterically hindered phenols as antioxidants and (e) residues from an oxo-alcohol synthesis, carried out with $C_3$–$C_5$-olefins as a solubilizing agent.

* * * * *

UNITED STATES PATENT AND TRADEMARK OFFICE

CERTIFICATE OF CORRECTION

PATENT NO. : 4,242,101

DATED : December 30, 1980

INVENTOR(S) : H.H. Vogel, K. Oppenlaender, and K. Starke

It is certified that error appears in the above—identified patent and that said Letters Patent is hereby corrected as shown below:

IN THE CLAIMS

In line 1 of Claims 2, 3 and 4, "addition" should read -- additive --.

Signed and Sealed this

*Eleventh* Day of *May 1982*

[SEAL]

*Attest:*

GERALD J. MOSSINGHOFF

*Attesting Officer*

*Commissioner of Patents and Trademarks*